US008341893B2

(12) United States Patent
Jen

(10) Patent No.: US 8,341,893 B2
(45) Date of Patent: Jan. 1, 2013

(54) SEISMIC COUPLER

(75) Inventor: Liang Kung Jen, Taipei (TW)

(73) Assignees: Liang Kung Jen, Taipei (TW); Dave Jen, Coral Springs, FL (US); Chieh Jen, Taipei (TW)

( * ) Notice: Subject to any disclaimer, the term of this patent is extended or adjusted under 35 U.S.C. 154(b) by 14 days.

(21) Appl. No.: 13/081,455

(22) Filed: Apr. 6, 2011

(65) Prior Publication Data

US 2012/0255243 A1 Oct. 11, 2012

(51) Int. Cl.
*E04B 1/98* (2006.01)

(52) U.S. Cl. ..... 52/167.4; 52/167.2

(58) Field of Classification Search ..... 52/167.1–167.9, 52/223.4, 583.1, 848; 403/265, 267, 286, 403/293, 296, 43, 46, 48, 300, 305–307, 403/309, 312–314, 333–334, 356–357; 411/269; 14/22

See application file for complete search history.

(56) References Cited

U.S. PATENT DOCUMENTS

| | | | | | |
|---|---|---|---|---|---|
| 5,456,047 | A * | 10/1995 | Dorka | 52/167.4 |
| 5,459,973 | A * | 10/1995 | Baumann | 52/848 |
| 5,606,839 | A * | 3/1997 | Baumann | 52/848 |
| 5,765,322 | A * | 6/1998 | Kubo et al. | 52/167.7 |
| 5,884,440 | A * | 3/1999 | Kubo et al. | 52/167.1 |
| 6,065,263 | A * | 5/2000 | Taguchi | 52/583.1 |
| 6,235,400 | B1 * | 5/2001 | Natsubori et al. | 428/468 |
| 6,327,829 | B1 * | 12/2001 | Taguchi | 52/583.1 |
| 6,631,592 | B1 * | 10/2003 | Hancock | 52/167.4 |
| 6,679,024 | B2 * | 1/2004 | Dahl | 403/265 |
| 7,565,774 | B2 * | 7/2009 | Shizuku et al. | 52/167.1 |
| 7,774,996 | B2 * | 8/2010 | Mualla | 52/167.4 |
| 2007/0267139 | A1 * | 11/2007 | Fisher | 156/304.2 |

* cited by examiner

*Primary Examiner* — Brian Glessner
*Assistant Examiner* — Beth Stephan

(57) ABSTRACT

A seismic coupler includes two coupling members each having an end receptacle for securing to a reinforcing bar of a column of reinforced concrete; and a flexible assembly comprising a cylindrical core formed of alloy, a plurality of steel first rings put on the core, a plurality of flexible second rings put on the core in an alternating fashion with respect to the first rings, a flexible sleeve put on the first and second rings to have both ends being flush with that of the core, two cup-shaped cap members engaged each other to conceal the core, the first and second rings, and the sleeve, and two sets of a plurality of fasteners driven through the coupling members and the cup-shaped cap members into the first rings.

3 Claims, 8 Drawing Sheets

SEISMIC COUPLER

BACKGROUND OF THE INVENTION

1. Field of the Invention

The invention relates to earthquake engineering and more particularly to a seismic coupler for securing to a reinforcing bar of a column or beam of reinforced concrete with improved seismic performance.

2. Description of Related Art

For enhancing a building's seismic performance, a great variety of structural elements are developed. For example, typical damping mechanical couplers are installed in columns of a building. However, ability of withstanding heavy vertical load of the typical damping mechanical couplers is poor due to low tenacity.

Also, typical plastic mechanical couplers are installed in beams of a building for decreasing lateral displacement in the event of earthquake. However, ability of dispersing the shear wave energy between a wide range of frequencies of the typical plastic mechanical couplers is poor due to low plasticity.

Thus, the need of for enhancing the tenacity of columns and plasticity of beams of a building structure so as to survive an earthquake still exists.

SUMMARY OF THE INVENTION

It is therefore one object of the invention to provide a seismic coupler comprising two coupling members each having an end receptacle for securing to a reinforcing bar of a column of reinforced concrete; and a flexible assembly comprising a cylindrical core formed of alloy, a plurality of steel first rings put on the core, a plurality of flexible second rings put on the core in an alternating fashion with respect to the first rings, a flexible sleeve put on the first and second rings to have both ends being flush with that of the core, two cup-shaped cap members engaged each other to conceal the core, the first and second rings, and the sleeve, and two sets of a plurality of fasteners driven through the coupling members and the cup-shaped cap members into the first rings.

The above and other objects, features and advantages of the invention will become apparent from the following detailed description taken with the accompanying drawings.

DETAILED DESCRIPTION OF THE INVENTION

Figure 1:
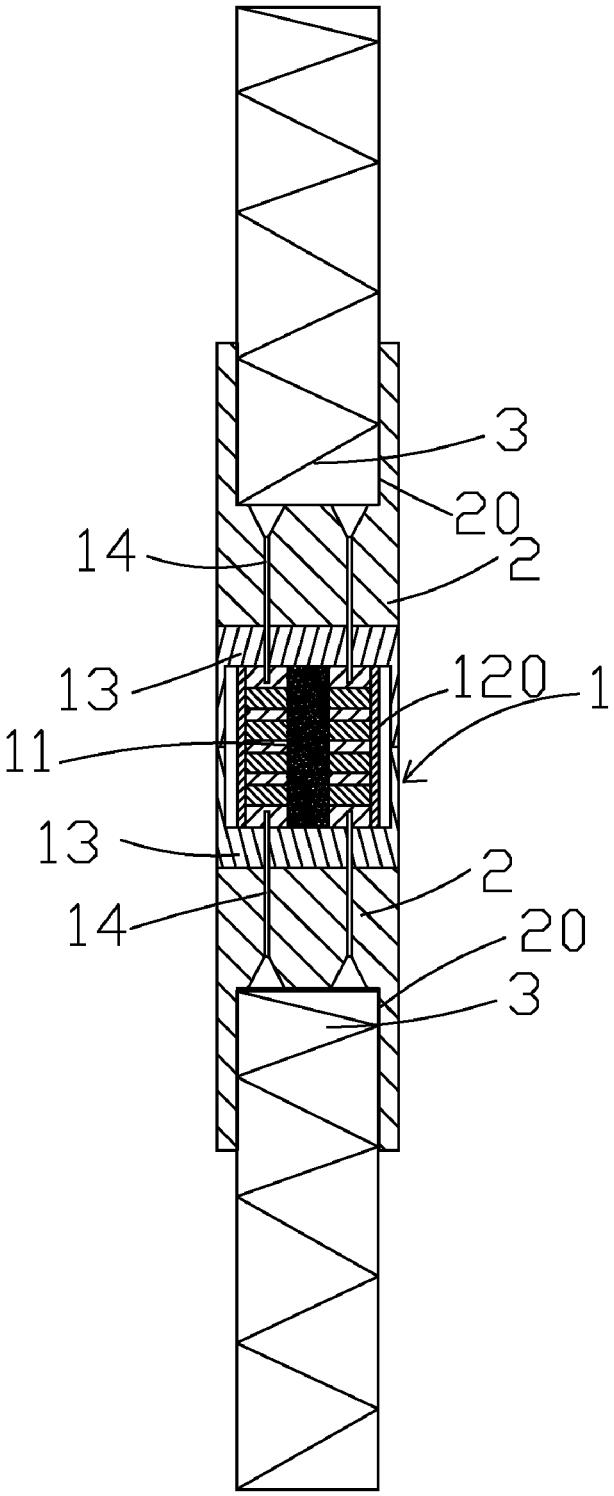
FIG. 1 is a longitudinal sectional view of a seismic coupler according to the invention, the seismic coupler being implemented as a basic configuration to be used in the construction of a column of reinforced concrete.

Referring to FIGS. 1 to 9, a seismic coupler in accordance with the invention comprises the following components as discussed in detail below.

A flexible assembly 1 is disposed between two reinforcing bars (i.e., rebars which are steel bar commonly used as a tensioning device in reinforced concrete and reinforced masonry structures holding the concrete in compression) 3. The flexible assembly 1 has alloy as detailed later. Two coupling members 2 are provided at both ends of the flexible assembly 1 respectively. Each coupling member 2 has a receptacle 20 at one end distal the flexible assembly 1 for clamping one end of the reinforcing bar 3.

As shown in FIG. 1, the flexible assembly 1 is implemented as a basic configuration with no connecting member being provided between the flexible assembly 1 and the coupling member 2. The cylindrical flexible assembly 1 comprises a cylindrical core 11 formed of alloy; five hard rings 121, 122, 123, 124, and 125 formed of steel plate and put on the core 11; four flexible rings 126, 127, 128, and 129 formed of rubber and put on the core 11 wherein the hard rings 121, 122, 123, 124, and 125 and the flexible rings 126, 127, 128, and 129 are arranged vertically in alternating fashion; a rubber sleeve 120 put on the hard rings 121, 122, 123, 124, and 125 and the flexible rings 126, 127, 128, and 129 to have both ends being flush therewith; two cup-shaped cap members 13 engaging each other to conceal above components of the flexible assembly 1; and two sets of four screws 14 driven through the coupling members 2 (i.e., bottoms of the receptacles 20) and the cup-shaped cap members 13 into the hard rings 121 and 125 respectively to fasten above components of the flexible assembly 1 together.

Figure 2:
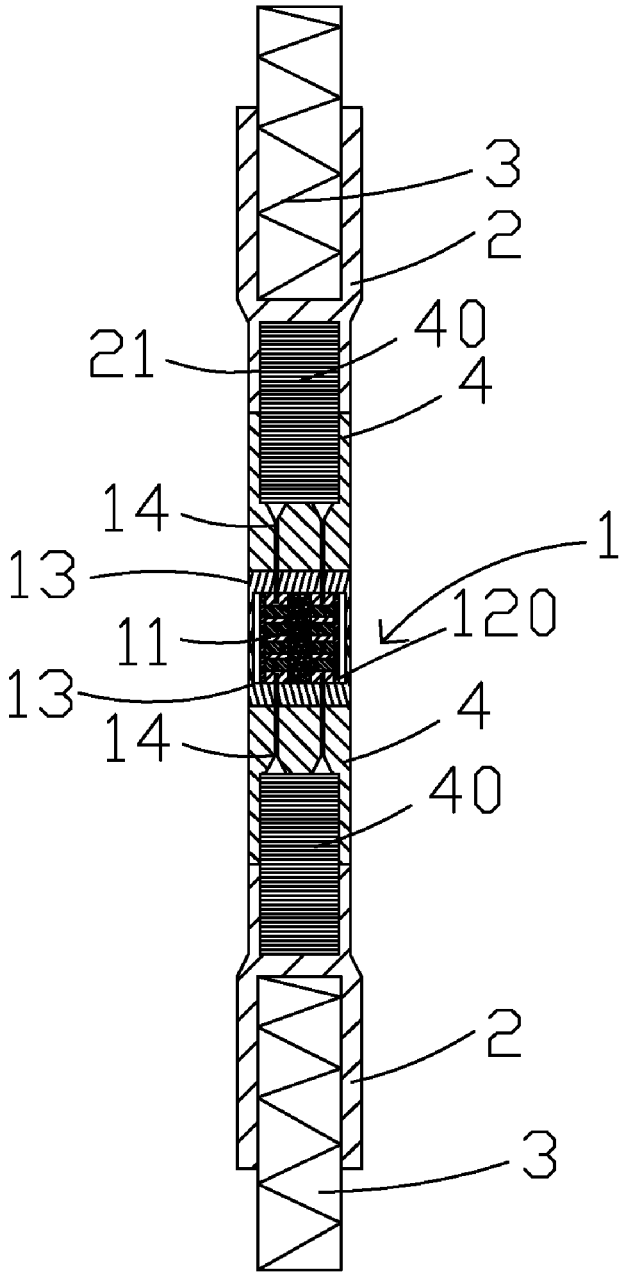
FIG. 2 is a view similar to FIG. 1 where a first preferred embodiment of the invention is shown.
Figure 4:
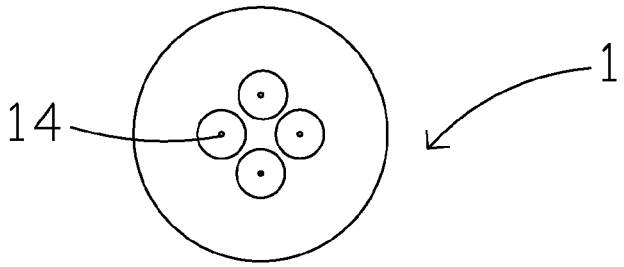
FIG. 4 is a top view of the first flexible assembly of FIG. 3.
Figure 3:
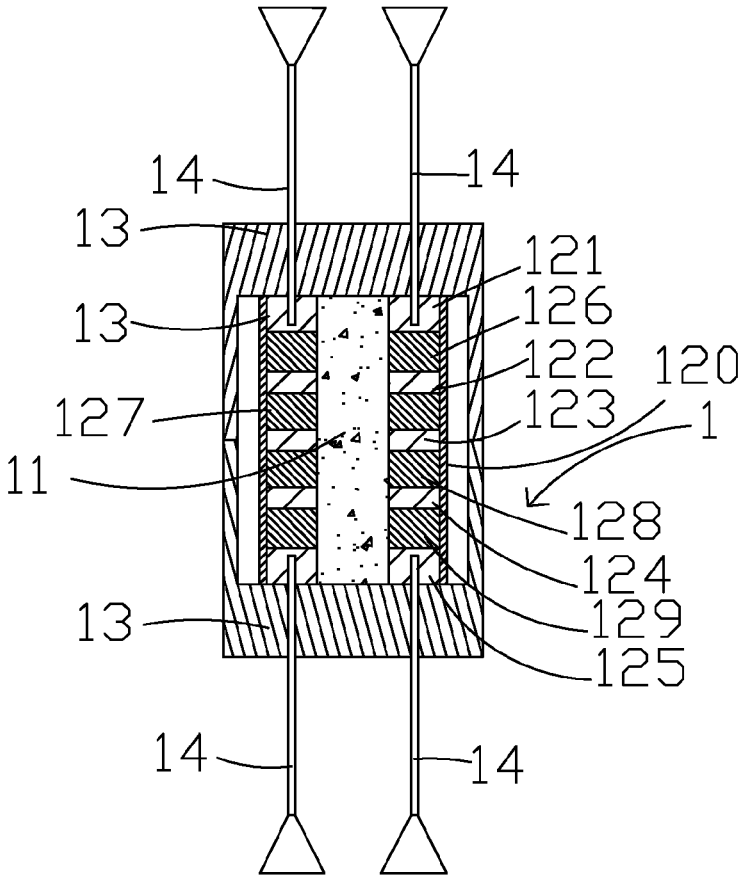
FIG. 3 is an enlarged view of the first flexible assembly.

As shown in FIG. 2, a first preferred embodiment of the invention is shown. For upper half portion, an inner surface of a hollow lower portion 21 of the coupling member 2 is formed with threads, an inner surface of an upper portion of a cup-shaped connecting member 4 is formed with threads, and a threaded bolt 40 is threadedly secured to the internal threads to fasten both the coupling member 2 and the connecting member 4. The lower half portion is a mirror image of the upper half portion.

Figure 5:
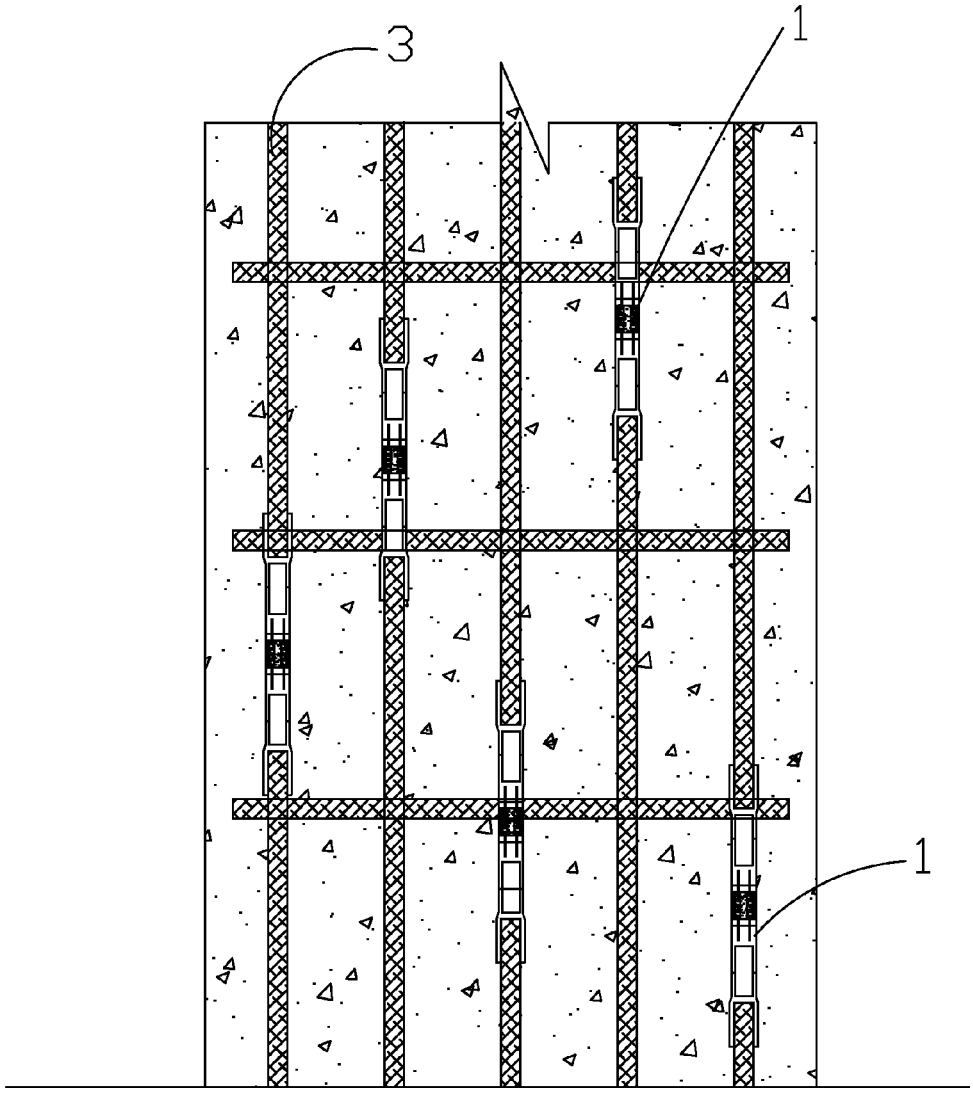
FIG. 5 is a longitudinal sectional view showing a column of reinforced concrete incorporating a plurality of first flexible assemblies arranged vertically parallel to one another.

It is noted that the above description is directed to a column. As shown in FIG. 5, a longitudinal sectional view shows a column of reinforced concrete incorporating a plurality of first flexible assemblies 1 arranged vertically parallel to one another.

Figure 6:
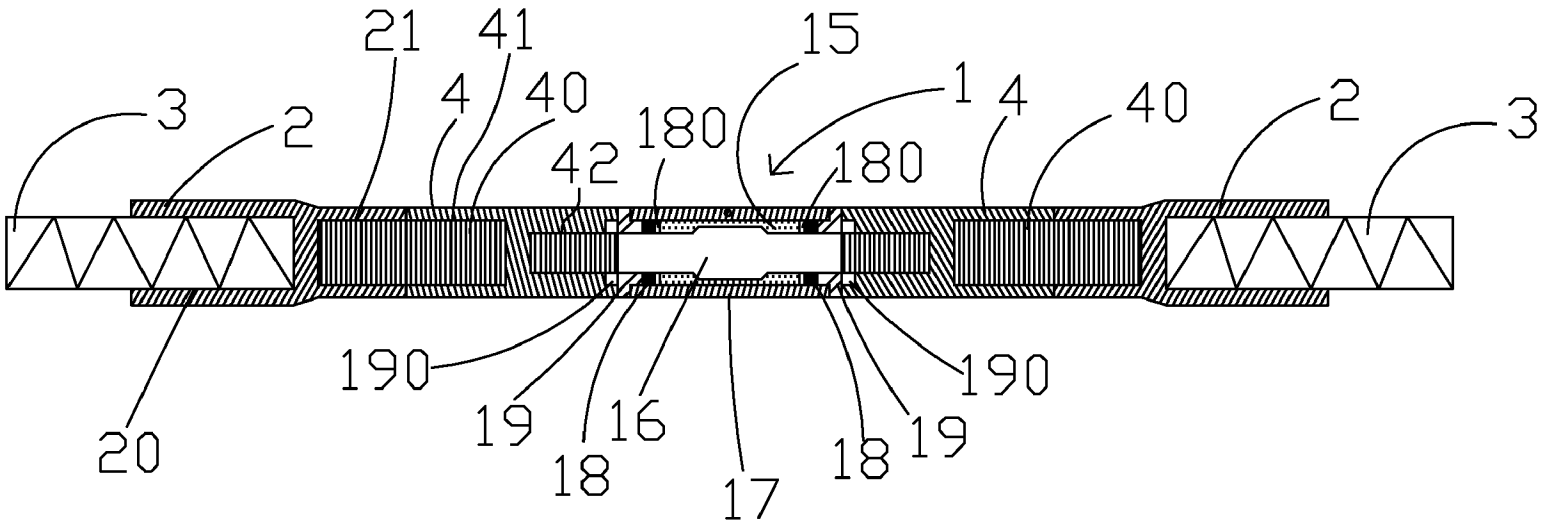
FIG. 6 is a longitudinal sectional view of a second preferred embodiment of the invention is shown.
Figure 7:
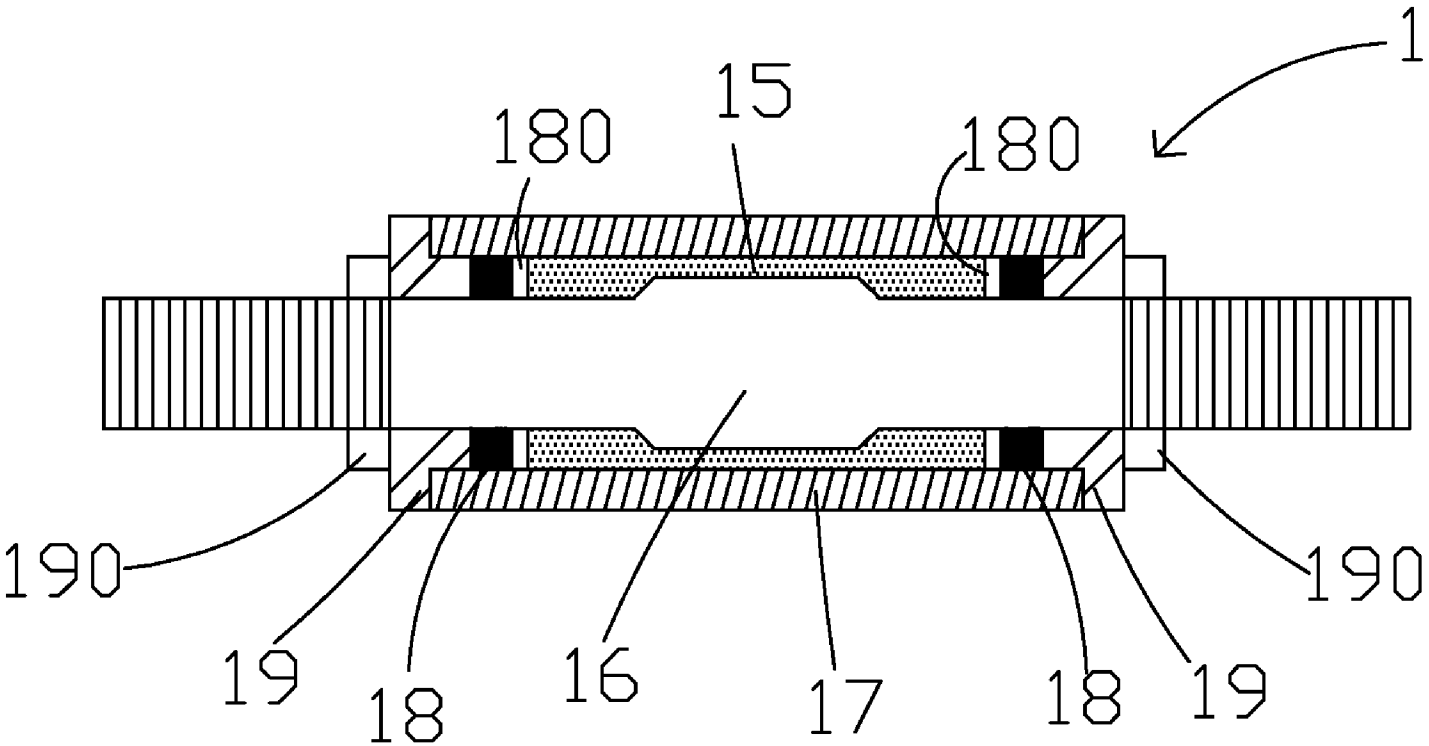
FIG. 7 is an enlarged view of the second flexible assembly.
Figure 8:
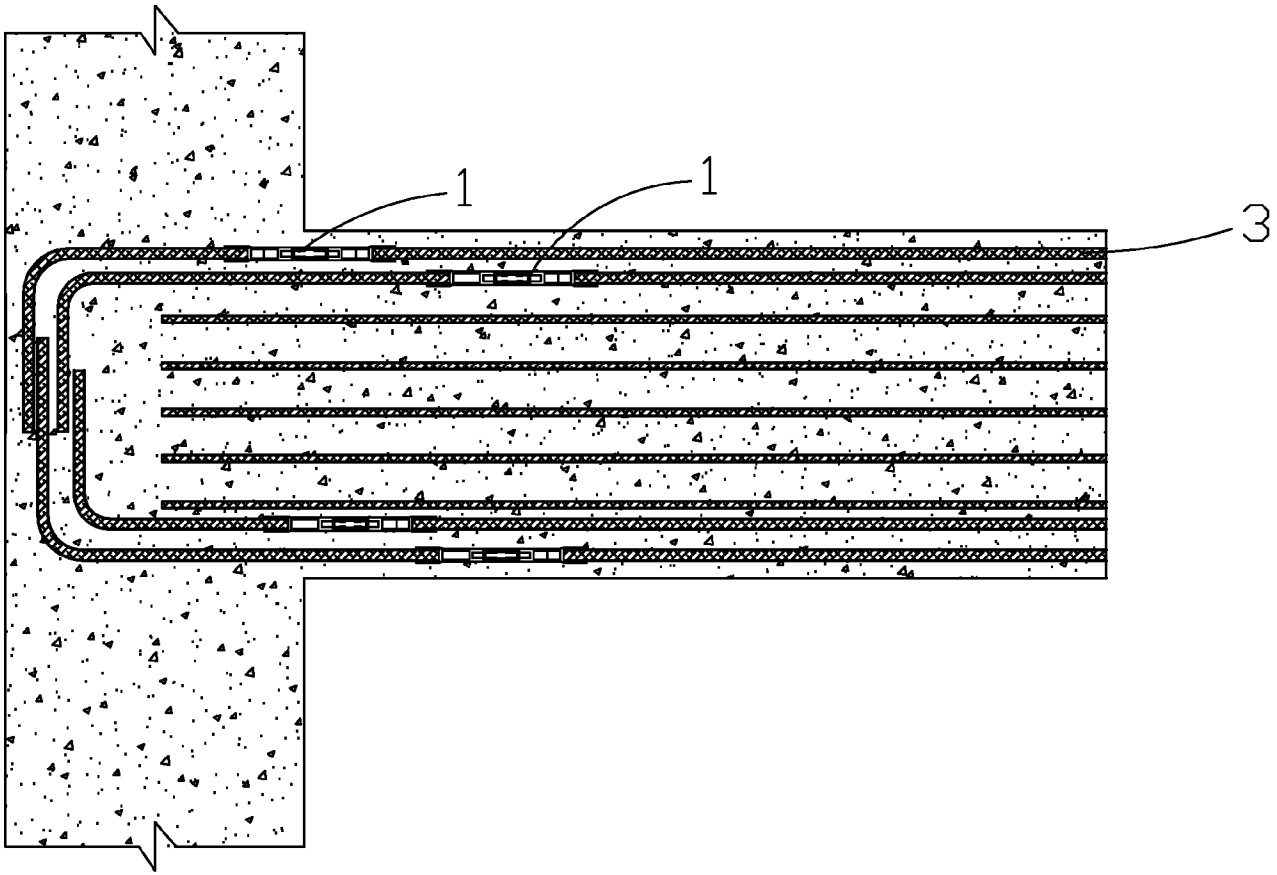
FIG. 8 is a longitudinal sectional view showing a joining of a beam of reinforced concrete and a column, the beam incorporating a plurality of second flexible assemblies arranged horizontally parallel to one another.

As shown in FIGS. 6 to 8, a second preferred embodiment of the invention directed to a beam is shown. The flexible assembly 1 comprises a threaded member 16 having two externally threaded end portion and a bare portion therebetween; an inner sleeve 15 of alloy put on a substantial portion of the bare portion of the threaded member 16; two steel rings 180 put on the bare portion of the threaded member 16 to urge against two ends of the inner sleeve 15 respectively; two rubber rings 18 put on the bare portion of the threaded member 16 to sealingly engage with the steel rings 180 respectively; an outer sleeve 17 of steel put on the rubber rings 18, the steel rings 180, and the inner sleeve 15; two steel caps 19 fitted at both ends of the outer sleeve 17 to engage with the steel rings respectively; and two nuts 190 each threadedly secured onto the threaded portion of the threaded member 16 to fasten the above components together.

Moreover, as shown in FIG. 6, for left half portion, a coupling member 2 comprises first receptacle 20 at one end for securing to a reinforcing bar 3 of a beam of reinforced concrete, and an internally threaded second receptacle 21 at the other end, an inner surface of a right portion of the coupling member 2 is formed with threads, an inner surface of a hollow left portion 41 of a connecting member 4 is formed with threads and that of a hollow right portion 42 thereof is formed with threads, a threaded bolt 40 is threadedly secured to the internal threads 21, 41 to fasten both the coupling member 2 and the connecting member 4, and the internal threads 42 are secured to one threaded portion of the threaded member 16 to conceal and urge the nut 190 against the steel cap 19. The right half portion is a mirror image of the left half portion.

Both the flexible assemblies 1 and the coupling members 2 are precast. Only the connecting members 4 are required to assemble with other components in situ. Thus, a structure incorporating the invention can be built quicker than conventional structures.

As shown in FIG. 8, it is a longitudinal sectional view showing a joining of a beam of reinforced concrete and a column, the beam incorporating a plurality of second flexible assemblies 1 arranged horizontally parallel to one another.

Figure 9:
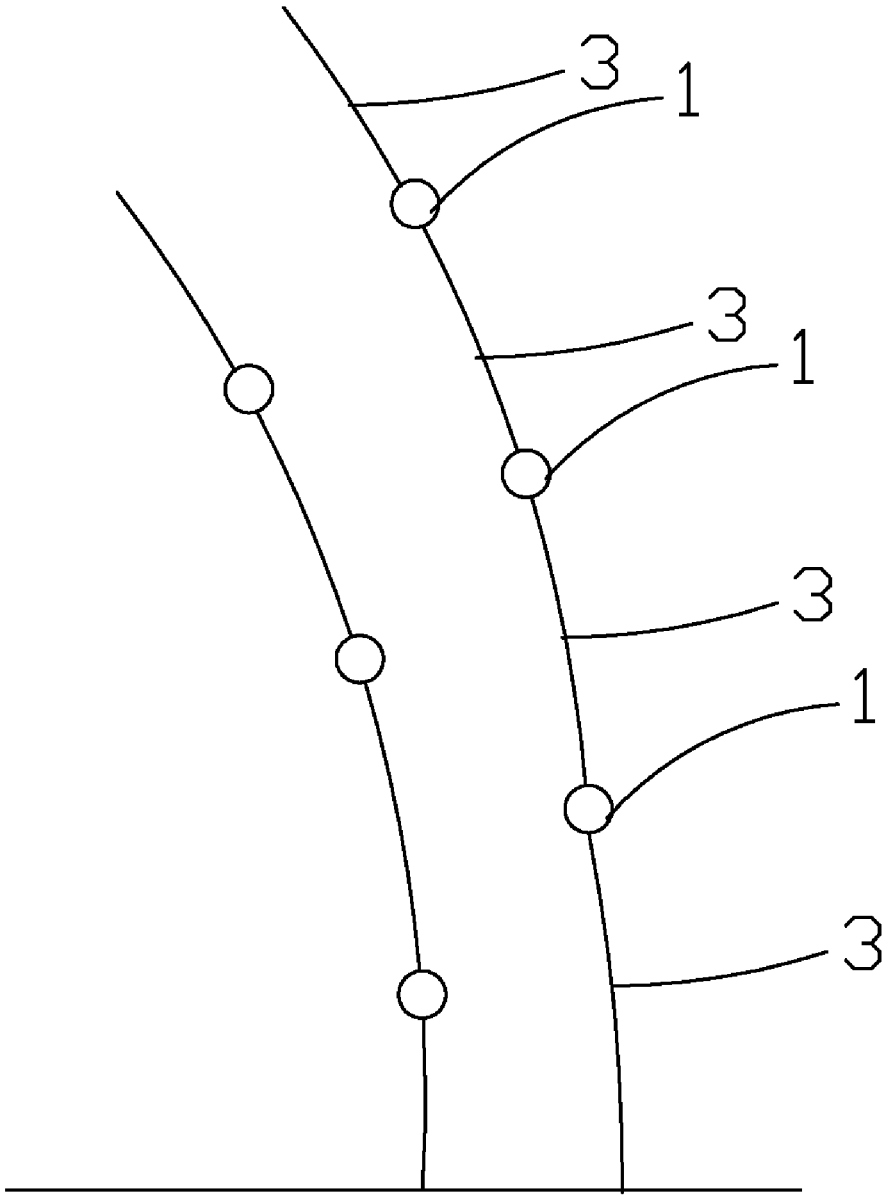
FIG. 9 schematically depicts two columns including a plurality of reinforcing bars wherein two adjacent reinforcing bars are connected together by a flexible assembly, and the columns are flexibly bent in response to tremor.

As shown in FIG. 9, it schematically depicts two columns including a plurality of reinforcing bars 3 wherein two adjacent reinforcing bars 3 are connected together by a flexible assembly 1, and the columns are flexibly bent in response to tremor. It is envisaged by the invention that tremor caused by earthquake can be substantially distributed to the reinforcing bars 3 and the flexible assemblies 1 of a building or non-building structure. Thus, its seismic performance is greatly improved.

The seismic coupler is implemented as a high tenacity mechanical coupler when it is applied to column. It is envisaged by the invention that a column incorporating the high tenacity mechanical coupler can withstand more vertical load and cause less lateral displacement as compared with the prior art.

The seismic coupler is implemented as a high plastic mechanical coupler when it is applied to beam. It is envisaged by the invention that a beam incorporating the high plastic mechanical coupler can be flexibly deformed without failure as compared the prior art.

It is envisaged that no threading is formed on the reinforcing bar. Thus, the structural strength of the reinforcing bar can be maintained.

While the invention has been described in terms of preferred embodiments, those skilled in the art will recognize that the invention can be practiced with modifications within the spirit and scope of the appended claims.

What is claimed is:

1. A seismic coupler, comprising:

two coupling members each comprising a first receptacle at one end for securing to a reinforcing bar of a column of reinforced concrete, and an internally threaded second receptacle at the other end;

two cup-shaped connecting members each comprising an internally threaded inner surface;

two threaded bolts each threadedly secured to both the internally threaded inner surfaces of one of the connecting members and one of the internally threaded second receptacles to secure one of the coupling members to one of the connecting members; and a flexible assembly comprising a cylindrical core formed of alloy, a plurality of steel first rings put on the core, a plurality of flexible second rings put on the core in an alternating fashion with respect to the first rings, a flexible sleeve put on the first and second rings to have both ends of the sleeve flush with both ends of the core, two cup-shaped cap members engaging each other to conceal the core, the first and second rings, and the sleeve, and two sets of a plurality of fasteners driven through the connecting members and the cup-shaped cap members into the first rings.

2. A seismic coupler comprising:

two coupling members each comprising a first receptacle at one end for securing to a reinforcing bar of a beam of reinforced concrete, and an internally threaded second receptacle at the other end;

a flexible assembly comprising a threaded member comprising two externally threaded end portion and a bare portion therebetween, an alloy inner sleeve put on a substantial portion of the bare portion of the threaded member, two steel rings put on the bare portion of the threaded member to urge against both ends of the inner sleeve respectively, two flexible rings put on the bare portion of the threaded member to sealingly engage with the steel rings respectively, a steel outer sleeve put on the flexible rings, the steel rings, and the inner sleeve, two steel caps fitted at both ends of the outer sleeve to engage with the steel rings respectively, and two nuts each threadedly secured onto the threaded portion of the threaded member;

two connecting members each comprising two internally threaded inner surfaces at both ends respectively wherein the internally threaded inner surface at one end thereof is secured to the threaded portion of the threaded member to conceal and urge the nut against the steel cap; and two threaded bolts each threadedly secured to both the internal threaded second receptacle of the coupling member and the internally threaded inner surface at the other end of the connecting member to fasten the coupling member and the connecting member together.

3. A seismic coupler, comprising:

two coupling members each having an end receptacle for securing to a reinforcing bar of a column of reinforced concrete; and a flexible assembly comprising a cylindrical core formed of alloy, a plurality of steel first rings put on the core, a plurality of flexible second rings put on the core in an alternating fashion with respect to the first rings, a flexible sleeve put on the first and second rings to have both ends of the sleeve flush with both ends of the core, two cup-shaped cap members engaging each other to conceal the core, the first and second rings, and the sleeve, and two sets of a plurality of fasteners driven through the coupling members and the cup-shaped cap members into the first rings.

* * * * *